United States Patent [19]

Levine

[11] Patent Number: 5,073,131

[45] Date of Patent: Dec. 17, 1991

[54] FUSE HOLDER

[75] Inventor: Mark Levine, Plainview, N.Y.

[73] Assignee: General Automotive Specialty Co., Inc., North Brunswick, N.J.

[21] Appl. No.: 646,874

[22] Filed: Jan. 28, 1991

[51] Int. Cl.[5] ..... H01R 13/68; H01R 33/94

[52] U.S. Cl. ..... 439/621; 437/199; 437/201

[58] Field of Search ..... 439/621, 717, 722; 337/187, 188, 197–199, 201

[56] References Cited

U.S. PATENT DOCUMENTS

| | | | |
|---|---|---|---|
| 4,722,701 | 2/1988 | Bradt | 439/621 X |
| 4,872,262 | 10/1989 | Marach | 28/884 |
| 4,944,691 | 7/1990 | Marach | 413/516 |

OTHER PUBLICATIONS

"Blade-Type Fuse Panels", BUSS ATC Fuse Panels, Bussman catalog, Jan. 1991.

*Primary Examiner*—Eugene F. Desmond
*Attorney, Agent, or Firm*—Darby & Darby

[57] ABSTRACT

A fuse holder has a base, an electrically conductive element and a cover which secures the element to the base. The base has opposite sides formed with projections and recesses which are releasably engageable with complementary recesses and projections of another base. The conductive element is arranged to contact a conductive element on the other base when the releasable locking position is reached. The conductive element has arms from which project contacts that are electrically isolated from other cooperating contacts. By inserting fuse terminals through slots in a cover that are directly over the contacts and cooperating contacts, electrical connection is made between the contacts and the cooperating contacts. Preferably, four, six or fourteen fuses may be held at the same time by any one fuse holder.

23 Claims, 3 Drawing Sheets

FIG. 5
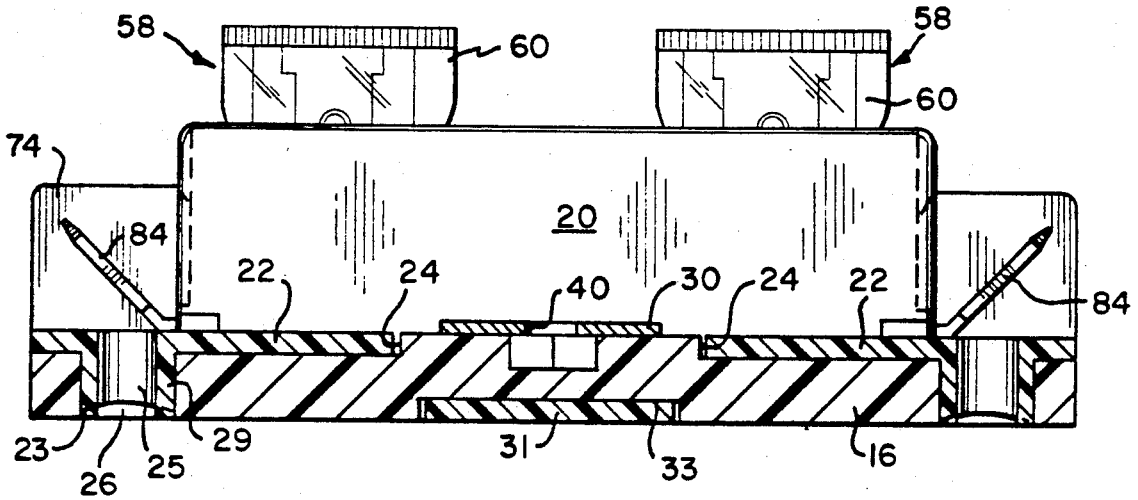
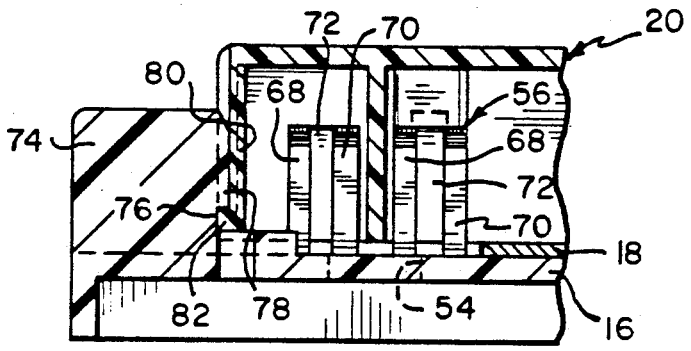
FIG. 4
FIG. 6
PRIOR ART
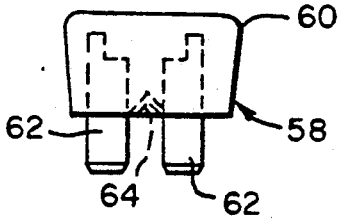

FUSE HOLDER

The present invention relates to a holder of fuses, such as ATO fuses.

A conventional fuse holder has electrically isolated contact terminals and a conductive metallic bus forming a common terminal and mounted on an insulating base with an insulating cover releasably secured to the base. A power source may be electrically connected to the bus. The bus has a group of arms, from which extend contacts in an upright manner, so that the contacts may be put in an electrical connection with the power source. The fuse holder has another group of contacts which may be put into electrical connection with respective power consuming devices. The two groups of contacts are arranged in pairs, each pair being adapted to receive a fuse therebetween, so that each power consuming device will be connected to the power source through a respective fuse.

The cover has slots, each being directly over a respective pair of contacts, so that two fuse terminals (such as of an ATO flat fuse) may be inserted through a slot in the cover to become releasably and electrically connected to the respective contacts that are immediately beneath the respective slot. Typically, up to fourteen fuses may be held in this manner by respectively different holders, which enables electrical connection of the power source with up to fourteen separate power consuming devices via the fourteen fuses.

To accommodate differing numbers of fuses, one way is to provide different fuse holders, each holding a respective number of fuses. This requires separate molds for bases and covers, and separate arrangement of contacts, thereby increasing the costs of providing a full range of sizes of fuse holders. Alternatively, for applications requiring more than the fixed number of fuses accepted by such a fuse holder, additional fuse holders must be acquired and separately connected to the power supply, or else a larger-capacity fuse holder must be substituted.

It would be desirable to minimize the added costs associated with providing a full range of fuse holder sizes, and to eliminate the need for separately routing connections from the power source to each fuse holder. In addition, the length of the fuse holder should be as small as possible to conserve space by accommodating only the number of fuses required for a given application.

SUMMARY OF THE INVENTION

The present invention is directed to a modular fuse holder permitting a plurality of such holders to be assembled into a composite fuse holder capable of holding a desired number of fuses of desired size. By the present design, a small number of differently sized fuse holders, each capable of holding a different number of fuses, can be connected together as desired to form a full range of fuse holders. For example, fuse holders of three different sizes, each capable of holding a different number of fuses (two or greater), may be readily connected in pairs. This provides six different holder sizes. Four more sizes are provided by taking one holder at a time or al three together. More sizes may be provided by providing and connecting together more than three fuse holders.

The present invention provides a fuse holder having a conductive metallic bus that is held on an insulating base by an insulating conductive cover. The bus has two groups of lateral arms, each arm having a contact which extends upright from and substantially perpendicular to the arm. The base and cover also hold two groups of individual terminals, each terminal being laterally spaced from a respective contact by a gap and each having its own contact. The contacts on either side of the gap form a socket to receive the respective legs of a fuse, such as of the ATO type. The cover has slots, each slot being directly over a contact from the arm and a respective contact from the terminal.

The base has projections and recesses which extend from two opposite ends of the base and are adapted to resiliently engage with complementary projections and recesses on another base. At the same time that this engagement is made, the bus of one fuse holder is adapted to contact that of another fuse holder. That is, when two fuse holders are connected together mechanically by their projections and recesses, one end of the bus on one base becomes arranged immediately beneath and in contact with the other end of the corresponding bus on the other base to become connected electrically. This arrangement thus connects the bus of each holder with that of all adjacent holders, and avoids the need to separately connect each fuse holder to a power source, because only one electrical connection need be made from the power source.

A number of fuse holders may be interconnected with each other in this way in a successive manner. The fuse holders may be either identical or else differ from each other only by different lengths and by the number of fuses which may be accommodated.

Preferably, two types of fuse holders are provided; one which accommodates four and one which accommodates six fuses. These two sizes are desirable since they represent a basic unit size which, when combined with each other and/or with like fuse holder sizes, may accommodate any number of fuses for a desired application (e.g., to provide for twelve fuses, either three fuse holders which accommodate four fuses each or two fuse holders which accommodate six fuses each may be selected; for ten fuses, a 4-fuse holder is combined with a 6-fuse holder, etc.) To accommodate a large capacity of fuses, a further size, such as a 14-fuse size, may be added. Thus, by only a few sizes of holders, a wide range of fuse capacity may be provided.

The invention also includes a ground contact holder that has a base which is resiliently engageable in the same manner to any of the fuse holder bases via complementary side projections and recesses formed in the base of the ground contact holder. The ground contact holder is a separate, and thereby optional, attachment so that it may be connected only if its use is needed, e.g., for marine applications. The ground contacts themselves are electrically isolated from the bus of the fuse holder by a wall.

BRIEF DESCRIPTION OF THE DRAWINGS

For a better understanding of the present invention, reference is made to the following description and accompanying drawings, while the scope of the invention is pointed out in the appended claims.

FIGS. 3 to 5 are cross-sections respectively across section lines 3—3, 4—4 and 5—5 of FIG. 2.

FIG. 6 is a plan view of a conventional ATO flat fuse.

DESCRIPTION OF THE PREFERRED EMBODIMENT

Figure 3:
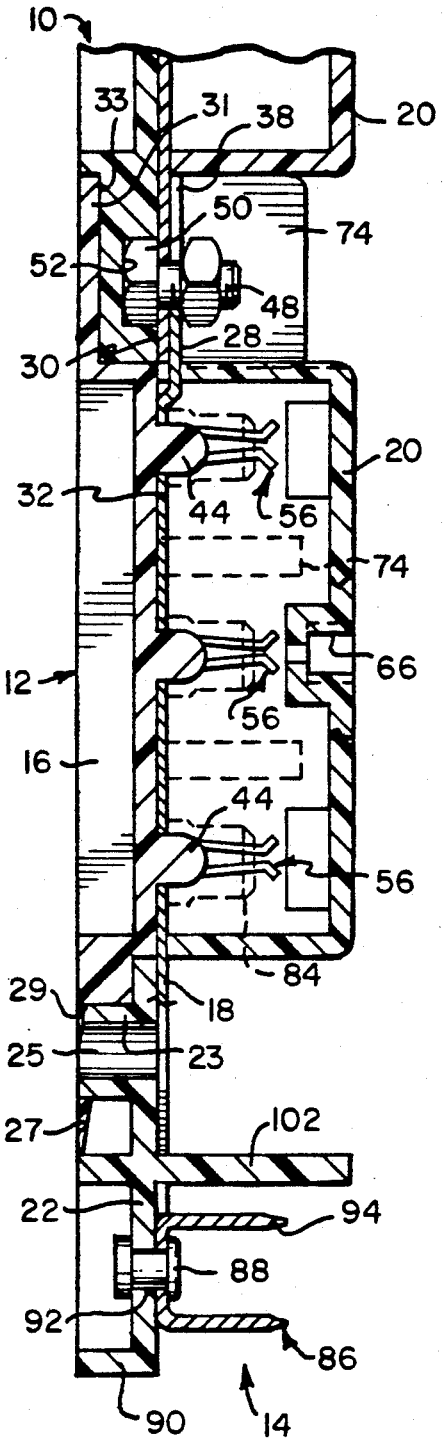

Turning to FIGS. 1 to 5, a first fuse holder 10, a second fuse holder 12, and a ground contact holder 14 are resiliently engageable with each other. Each fuse holder 10, 12 has a base 16, metallic bus 18 and a cover 20 which retains the bus 18 against the base 16 (see FIGS. 2 and 3). The base 16 and cover 20 are made of an insulating material such as nylon, while the bus 18 is of course electrically conductive.

Each base 16 has a pair of flat projections 22 extending outwardly from the top surface of the base, at one end (here called end A), on either side of a central area. Each base 16 also has a pair of complementary recesses 24 in its top surface at the other end (i.e. end B), so that projections 22 of end A of one base may engage recesses 24 of end B of another base. Each projection 22 may be somewhat flexible and has a boss 23 with a wall 29 surrounding a hole 25. Each recess 24 has a hole 26 adapted to be aligned with and engage a corresponding boss 23 of an adjoining base when two bases are engaged. In this manner, hole 26 of end B of one base communicates with hole 25 of end A of the adjoining base.

Referring to FIG. 5, the lower surface of the base has a flat central recess 33 at end B adapted to engage projection 31 of an adjoining base and has a central flat projection 31 at end A. Projection 31 is thin and relatively flexible.

Figure 1:
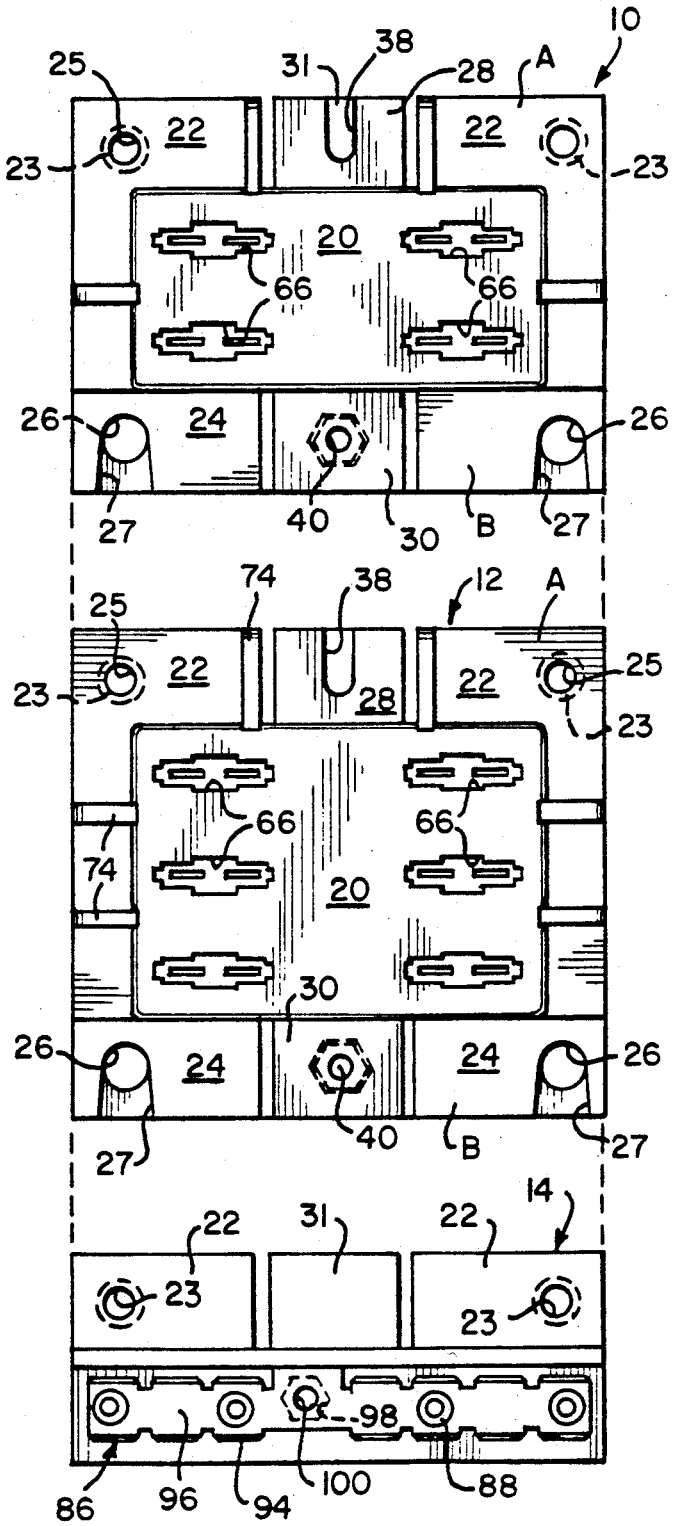
FIG. 1 is a top plan view of two fuse and ground contact holders in accordance with the invention prior to connecting them together.

In order to effect ready releasable engagement of a projection 22 of one base and a recess 24 of another base, a ramp 27 is provided on recess 24 that inclines from each hole 26 of the base 16 in a downward direction to the base edge (see FIGS. 1 and 3). Thus, as bosses 23 are being pushed along the ramps 27 for effecting engagement of two bases, a resilient force of increasing magnitude is created between the bases 16 by flexure of the central projection 31 of one base sliding into the central recess 33 of the other base. The outer diameter of the boss 23 is smaller than the inner diameter of hole 26 in its recess 24. Each boss 23 of end A of one base clicks into place in its hole 26 in the recess 24 of end B of another base after the respective boss 23 clears the ramp 27. At this stage, the two bases are releasably locked together by the bosses 23 of one base being within the holes 26 of the other base.

The degree of inclination of the ramp 27 is slight, e.g., between 5° to 20° or about 15°, but large enough to cause resilient flexure of projection 31 to take place at least by the time the walls 29 of bosses 23 of and A of one base are just about to clear the uppermost portion of ramp 27 of end B of another base. The lowest portion of the incline of the ramp 27 of end B of the other base allows the walls 29 of boss 23 at appreciable resilient engagement taking place. Similarly, the projection 31 may be inclined upward as it extends away from the rest of the base 16 in an unflexed state by approximately the same degree of inclination as the ramp 27.

After the walls 29 of end A of one base clear their ramps 27 of end B of another base and fit into the aligned holes 26 in the recesses 24 of end B of the other base to effect the releasable locking, disengagement may be subsequently effected by simultaneously raising the two upper end projections 22 and forcing the wall 29 of end A of the one base to again rest on the upper part of the incline of the ramp 27. Thereafter, the walls 29 of end A of the one base are slid down the ramps 27 of end B of the other base until the bases separate from each other.

The fuse holders may be mounted to a wall or surface with mounting screws that are extended through holes 26 and/or overlapped holes 25, 26.

The bus 18 has a raised end 28, a flat end 30, an elongated central portion 32 and two groups of lateral terminal arms 36. The raised end 28 has a groove or slot 38 and the flat end 30 has a hole 40. The raised end 28 extends in a plane above that of the flat end 30, e.g., at an elevation which is higher by at least the thickness of the flat end 30. The arms 34 on either side of the central portion 32 are spaced apart from each other uniformly along the length of the central portion 32 and extend in a direction substantially perpendicular to the direction of elongation of the central portion 32.

The central portion 32 of bus 18 has a series of uniformly spaced apart holes 42 through which extend a series of respective projections 44 from the base 16 to locate the strip on the base. The base 16 has a raised portion 46 whose contour conforms in shape to accommodate the contour of a portion of each metallic terminal arm 36 so as to retain each terminal arm 36 in position against lateral movement. Each terminal 36 has a hole 54 in which snugly fits a projection 55.

Upon full engagement of one base with an adjoining base, the hole 40 of the flat end 28 of a first fuse holder 10 is aligned with the slot 38 of the raised end 26 of a second fuse holder 12. A screw has a stem 48 which extends through both the hole 40 and slot 38. The head 50 of the screw is retained before this engagement is made in a recess 52, which conforms in shape to the head 50 of the screw. Thus, the screw is prevented from rotating independently while in the recess 52.

Figure 2:
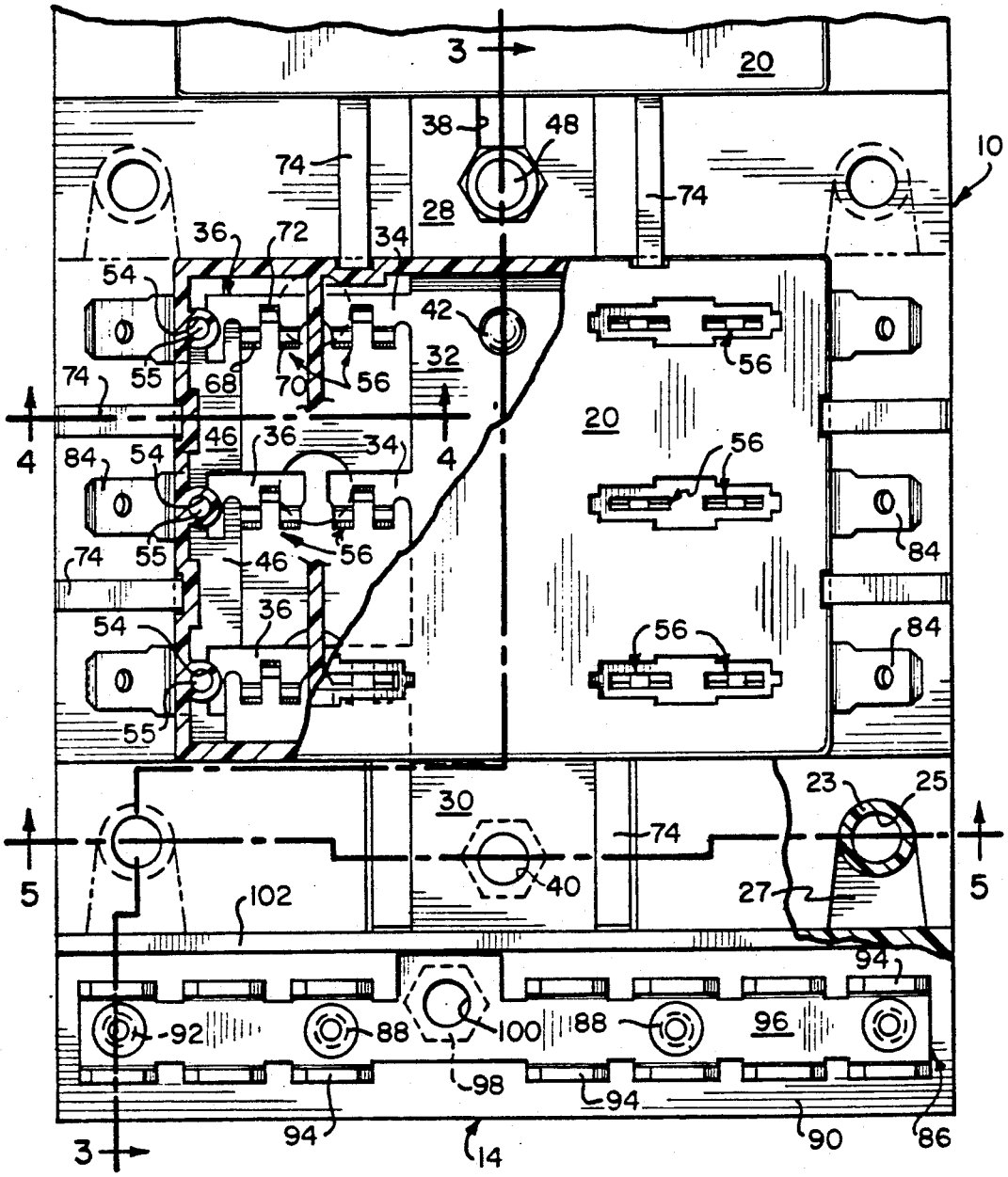
FIG. 2 is a partially broken top plan view of one fuse holder and the ground contact holder of FIG. 1 after connecting them together.

The spacing of arms 34 from respective terminals 36 is sized to enable the contacts 56 on either side of the gap to become electrically connected to each other via an ATO flat fuse 58 (see FIGS. 2, 5 and 6). The fuse 58 has a body element 60 from which extends the fuse terminals 62. A fuse link 64 extends between the fuse terminals 62 and breaks when current passing between the terminals via the link 60 exceeds a rated value.

For a 4-fuse, 6-fuse or 14-fuse holder, the cover 20 may have four, six or fourteen slots 66 as shown in FIG. 1. Each slot 66 has an upper portion, which conforms in shape to the outer periphery of the body element 60 of the fuse 58, and a lower portion, which conforms in shape to the periphery of the fuse terminals 62. When both fuse terminals 62 are passed through the lower portion of any slot 66, electrical contact is effected with a contact 56 from one arm 34 and a contact 56 from one terminal 36.

The contacts 56 of each arm and terminal include three biased terminals 68, 70, 72 which bias against opposite sides of the engaged fuse terminal, i.e., two (68, 70) are in line and bias against one face of the fuse terminal 62 from one direction and the third 72) biases against the other face of the fuse terminal 62 from the opposite direction.

Each of the three biased terminals has a free end which is bent outward in the direction to which it will be forced by the engaging fuse terminal 62 to move when the fuse terminals are inserted in the space between terminals 68, 70 and 72. This bent shape helps to guide the fuse terminals 62 into their proper location for engagement.

As seen in FIGS. 4 and 5, the base 16 also has ribs 74 which have a recessed portion 76 and a non-recessed portion 78. The cover 20 has a recessed portion 80 and a projection 82. When the cover 20 is inserted within the confines of the ribs 74 and into contact against the base 16, the recessed portion 76 of each of the ribs 74 resiliently engages the respective projection 82 of the cover 20 and the recessed portions 80 of the cover 20 resiliently engage the non-recessed portions 78 of the ribs 74, respectively. This resilient engagement retains the cover 20 against the base 16.

The raised end 28 and flat end 30 of the bus 18 are accessible by being outside of the cover 20. This accessibility enables a power source to be electrically connected thereto. Since the buses 18 of two or more adjoining and engaged fuse holders are electrically connected together, power may be supplied to all of the buses from the power source by merely connecting the power source once to any of the buses, e.g., an end one.

Leads (not shown) from power consuming devices (not shown) are connected to respective terminal ends 84 of the conductors 36. Fuse terminals 62 are then inserted into the slots 66 and thereby into engagement with respective pairs of contacts 56. In this manner electrical connection of the power source with the power-consuming devices via the fuses 58 is effected.

The grounding contact holder 14 has a ground contact 86 which is secured by rivets 88 to an insulating base 90 of the holder 14 in holes 92 formed in base 90. The ground contact 86 is metallic and has a plurality of terminals 94 which extend upright from a common electrically conductive plate portion 96.

Further, the insulating base 90 has a recess 98 which conforms in shape to the head of a non-circular screw and is directly under a hole 100 in the plate portion 96. When the non-circular head of the screw is placed into the recess 98 and is thus fixed against relative rotation, the threaded stem of the screw extends through the hole 100 in the plate portion 96. Such a screw may be electrically connected to a grounding sink. A wall 102 is between the ground contact 86 and the bus 18 so as to prevent the bus from becoming electrically grounded via the ground contact.

As described, the present invention is advantageous since any desired number of fuses may be accommodated by engaging a limited number of fuse holders, which have provision for holding preferably four or six fuses each or else any desired number. The engagement further electrically interconnects conductive elements of different fuse holders at the same time the holders become mechanically engaged with each other. A holder for ground contacts may be engaged in a like manner to provide a single location for grounding of power consuming devices, as is desirable for marine applications (e.g., on a ship, boat, etc.). A power source need only be connected to one bus of one fuse holder to provide power to all buses of the fuse holders, because the buses are electrically connected with each other upon engagement of their respective bases with each other.

While the foregoing description and drawings represent a preferred embodiment of the present invention, it will be understood that various changes and modifications may be made without departing from the spirit and scope of the present invention.

What is claimed is:

1. A fuse holder adapted to be coupled to another fuse holder of like structure, comprising:

an insulating base;

an electrically conductive element mounted on said base;

contact means including first contacts in electrical connection with said conductive element and second contacts which are electrically isolated from said first contacts and from said conductive element, said first and second contacts being arranged in pairs adapted for holding the fuse terminals of fuse elements; and releasable engaging means for releasably locking together said base with another like base and for simultaneously electrically connecting said conductive element with another conductive like element located on said other base as said bases are releasably locked together.

2. A fuse holder as in claim 1, further comprising:

a ground base which is insulative;

an electrically conductive ground element;

means for securing said ground element to said ground base, said ground base having complementary releasable engaging means for releasably locking together said insulating base and said ground base, said ground element being electrically isolated from said electrically conductive element.

3. A fuse holder as in claim 1, further including an insulating cover having slots, each slot being arranged over a respective pair of first and second contacts for enabling insertion of a pair of terminals of a fuse element therein, said conductive element being held on said base by said cover and having a portion accessible from outside said cover.

4. A fuse holder as in claim 3, wherein there are pairs of contacts numbering 4, 6 or 14 and said cover has a corresponding number of slots which enable insertion of fuse terminals from four, six or fourteen respective fuse elements at any one time.

5. A fuse holder as in claim 3, wherein said retaining means includes engaging projections and recesses formed on said base and cover, said projections of said retaining means extending along sides of said cover, said recesses of said retaining means resiliently engaging said projections of said retaining means.

6. A fuse holder as in claim 1, wherein said releasable engaging means includes recesses on one of said bases which are engageable with projections of the other base, at least one of said recesses having an inclined portion so that as one projection is forced onto said incline, another of said projections exert resilient force against another of said recesses by flexure of said another projection.

7. A fuse holder as in claim 1, wherein said insulating base has a recess conforming in shape to a non-circular head of a screw, said portion of said electrically conductive element having a hole directly over said recess so as to enable the stem of the screw to extend through said hole.

8. A fuse holder as in claim 6, wherein said releasable engaging means has holes which are arranged for aligning with holes of said other base when said bases become releasably locked together, said one projection clearing said incline to effect alignment of said holes.

9. A fuse holder as in claim 1, said releasably engaging means comprising: 'a first flat projection extending outwardly from a first surface of said base at one end of said base and being thinner than said base, a first recess formed in the other surface of said base at the other end of said base and extending along said base, said recess having a depth substantially equal to the thickness of said projection, aid base also including a second flat projection extending outwardly from eh other surface e of said base at the one end of said base and substantially to the same extent as the length of said first projection, said first recess being in axial alignment with said second projection, said base also including a second recess formed in said first bases surface at the other end thereof and extending along said base from said other end to substantially the same extent as the length of said first projection, said second recess being in axial alignment with said first projection, whereby on engaging two such bases, the first projection of one base will engage the second recess of the other and the fist recess of said one base will engage the second projection o the other.

10. A fuse holder as in claim 9, wherein:

said second projection includes a boss extending therefrom away from said first base surface and toward the base surface opposite said fist surface, said first recess including a hole therein, said boss of one base being adapted to engage the hole in another base upon coupling said one end of one base o the other end of said other bas.

11. A fuse holder as in claim 10, further comprising a ramp on either said boss or its cooperating flat projection.

12. A fuse holder as in claim 9 wherein:

said first projection and said second recess are located substantially along the central axis of said base, said second projection and said first recess are in substantial alignment alterally spaced apart form said axis on one side thereof, and further including a third projection similar to said second projection at the same end of said base as said second projection and a third recess similar to said first recess and at the same end of said base as said first recess, said third projection and said third recess being in substantial alignment laterally spaced from said axis on the other side of said axis from said second projection and first recess.

13. A fuse holder as in claim 12, wherein:

each said projection includes a boss extending therefrom away from said first base surface and toward the base surface opposite said first surface, each said recess including a hole therein, said boss of one base being adapted to engage the hole in another base upon coupling said one end of base to the other end of said other base.

14. A set of fuse holders as in claim 1, at least one of said holders having a different number of pairs of first and second contacts from the number of pairs of first and second contacts of another of said holders, whereby differing numbers of fuses may be accommodated by utilizing individual ones of said set or by joining different ones of said set of fuse holders.

15. A set of fuse holders as in claim 14, wherein said pair numbers are selected from the set of 4, 6 and 14.

16. In combination, a pair of fuse holders, (i) each having an insulating base, an electrically conductive element on said base, said conductive element having a plurality of first contacts connected thereto, and a like plurality of terminals on said base, each having a second contact separated from a respective first contact, with each pair of one said first contact and one said second contact being adapted to engage the terminals of a fuse, and (ii) releasable engaging means for releasably locking one end of the base of the holder to the opposite end of the base of the other holder and for simultaneously connecting said conductive elements of said two bases.

17. The combination as in claim 16, wherein said plurality of first contacts of one said base differs in number from the plurality of said first contacts on the other base.

18. A fuse holder, comprising:

an electrically conductive element having a substantially flat elongated central portion, arms projecting from said central portion and spaced apart from each other, first biased contacts which extend substantially perpendicular to and from said first arms, terminals which extend in line with said first arms but are electrically isolated therefrom, second biased contacts which extend substantially perpendicular to and from said terminals, said terminals having holes, said first and second biased contacts being arranged relative to each other for enabling insertion of one fuse terminal of one flat fuse to be releasably held by said first biased contacts of one of said arms and of another fuse terminal of the one flat fuse to be releasably held simultaneously by said second biased contacts of a corresponding one of said terminals that is in line with said one arm, a first end extending from said conductive element central portion and having a hole spaced from an edge of said first end by a first distance, and a second end of said conductive element central portion being raised to extend at a different elevation than that of said first end by an amount which is at least equal to a thickness of said first end, said second end having a slot which extends in the direction of elongation of said central portion and by a distance from the edge of said second end by substantially said first distance.

19. A fuse holder as in claim 18, further comprising:

a base which is electrically non-conductive and has means for retaining said electrically conductive element in position thereon against relative lateral movement, said central portion having a series of holes, said retaining means including means for engaging said holes in said central portion.

20. A fuse holder as in claim 18, further comprising means for retaining said terminals to a base, said retaining means including means in contact with projections from said base which have a contour that abuts and conforms in shape to a portion of the contour of said terminals, said terminals each having a respective hole, said retaining means including projections which snugly fit into said holes of said terminals, respectively.

21. A fuse holder as in claim 19, further comprising projections and recesses formed on opposite sides of said base which are engageable with complementary recesses and projections, respectively, of two other like bases, one of said first and second ends of said electrically conductive element being arranged to contact an identically electrically conductive element on one of said two other like bases upon engagement of said projections and recesses with said complementary recesses and projections.

22. A ground contact holder, comprising:

a base which is electrically non-conductive;

an electrically conductive element secured to said base, said element having a plate portion and a plurality of terminals extending from said plate portion substantially perpendicular relative to said plate portion;

engaging means extending from said base for resiliently engaging complementary engaging means on a base of a fuse holder; and a wall portion which is electrically non-conductive and extends from said base at a location which is between where said element and said engaging means are located on said base.

23. A holder as in claim 22, wherein said base has a recess conforming in shape to a non-circular head of a screw, said plate portion having a hole directly over said recess so as to enable the stem of the screw to extend through said hole.

* * * * *